US010137422B2

(12) United States Patent
Sung

(10) Patent No.: US 10,137,422 B2
(45) Date of Patent: Nov. 27, 2018

(54) SHAKER

(71) Applicant: WISTRON CORP., New Taipei (TW)

(72) Inventor: Chen-An Sung, New Taipei (TW)

(73) Assignee: WISTRON CORP., New Taipei (TW)

( * ) Notice: Subject to any disclaimer, the term of this patent is extended or adjusted under 35 U.S.C. 154(b) by 241 days.

(21) Appl. No.: 15/245,358

(22) Filed: Aug. 24, 2016

(65) Prior Publication Data

US 2018/0001285 A1 Jan. 4, 2018

(30) Foreign Application Priority Data

Jun. 29, 2016 (TW) ..... 105120635 A

(51) Int. Cl.
*B01F 11/00* (2006.01)
*B06B 1/16* (2006.01)
*B06B 1/04* (2006.01)

(52) U.S. Cl.
CPC ..... *B01F 11/0008* (2013.01); *B01F 11/0014* (2013.01); *B01F 11/0034* (2013.01); *B06B 1/16* (2013.01); *B01F 2215/0037* (2013.01); *B06B 1/045* (2013.01)

(58) Field of Classification Search
CPC ..... B01F 11/0014; B01F 11/0034; F16C 39/063; F16H 49/005; H02K 49/102
USPC ..... 366/273, 274
See application file for complete search history.

(56) References Cited

U.S. PATENT DOCUMENTS 8,393,781 B2 * 3/2013 Manera ..... B01F 11/0008 366/112
2009/0040866 A1 * 2/2009 Rollin, III ..... B01F 11/0014 366/219

* cited by examiner

*Primary Examiner* — Tony G Soohoo
*Assistant Examiner* — Elizabeth Insler
(74) *Attorney, Agent, or Firm* — Maschoff Brennan

(57) ABSTRACT

A shaker includes a base, a holder and a drive assembly. The holder is movably disposed on the base. The drive assembly includes a first eccentric shaft, a second eccentric shaft, a drive shaft, plural magnetic members and a power source. The first eccentric shaft includes a first part and a second part which are non-coaxial. The first part is pivoted on the holder. The second eccentric shaft includes a third part and a fourth part which are non-coaxial. The third part is pivoted on the holder. Two ends of the drive shaft respectively correspond to the second and the fourth parts. The magnetic members are respectively disposed on the second, the fourth parts and the two ends of the drive shaft. The power source is used for rotating the first eccentric shaft, and rotating the second eccentric shaft through the magnetic members and the drive shaft.

9 Claims, 7 Drawing Sheets

SHAKER

CROSS-REFERENCE TO RELATED APPLICATIONS

This non-provisional application claims priority under 35 U.S.C. § 119(a) on Patent Application No(s). 105120635 filed in Taiwan, R.O.C. on Jun. 29, 2016, the entire contents of which are hereby incorporated by reference.

TECHNICAL FIELD

The disclosure relates to a shaker, more particularly to a shaker having non-contact transmission mechanism.

BACKGROUND

A tube shaker is a piece of laboratory equipment used to shake, mix, blend, or to agitate substances in tube(s) or flask(s) by shaking them, which is mainly used in the fields of chemistry and biology.

SUMMARY

One embodiment of the disclosure provides a shaker including a base, a holder and a drive assembly. The holder is movably disposed on the base. The drive assembly includes a first eccentric shaft, a second eccentric shaft, a drive shaft, a plurality of magnetic members and a power source. The first eccentric shaft includes a first part and a second part which are non-coaxial. The first part is pivoted on the holder. The second eccentric shaft includes a third part and a fourth part which are non-coaxial. The third part is pivoted on the holder.

Two opposite ends of the drive shaft respectively correspond to the second part and the fourth part. The magnetic members are respectively disposed on the second part, the fourth part and the two opposite ends of the drive shaft. The power source is used for rotating the first eccentric shaft, and rotating the second eccentric shaft through the magnetic members and the drive shaft.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION

Figure 1:
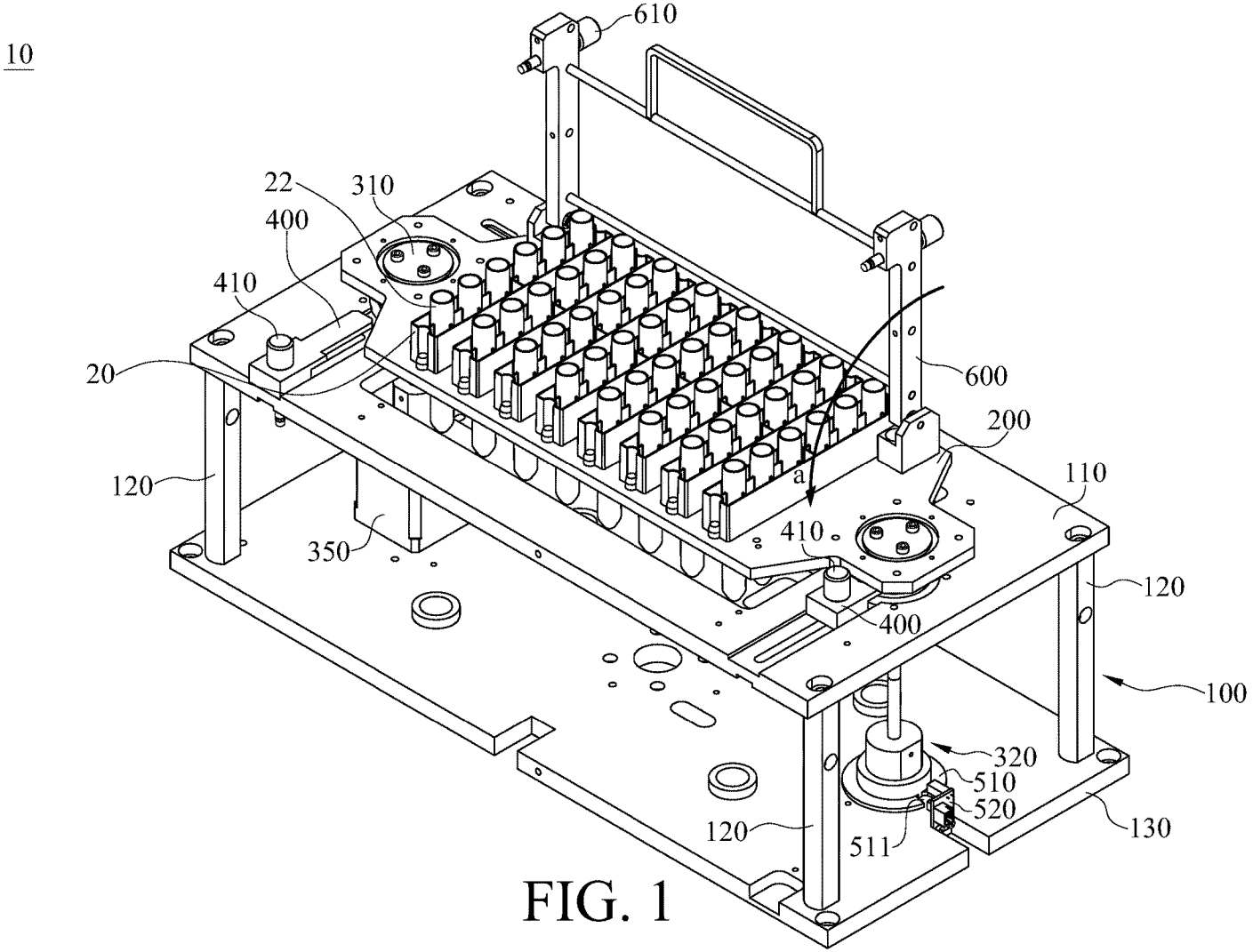
FIGS. 1-2 are perspective views of a shaker according to a first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
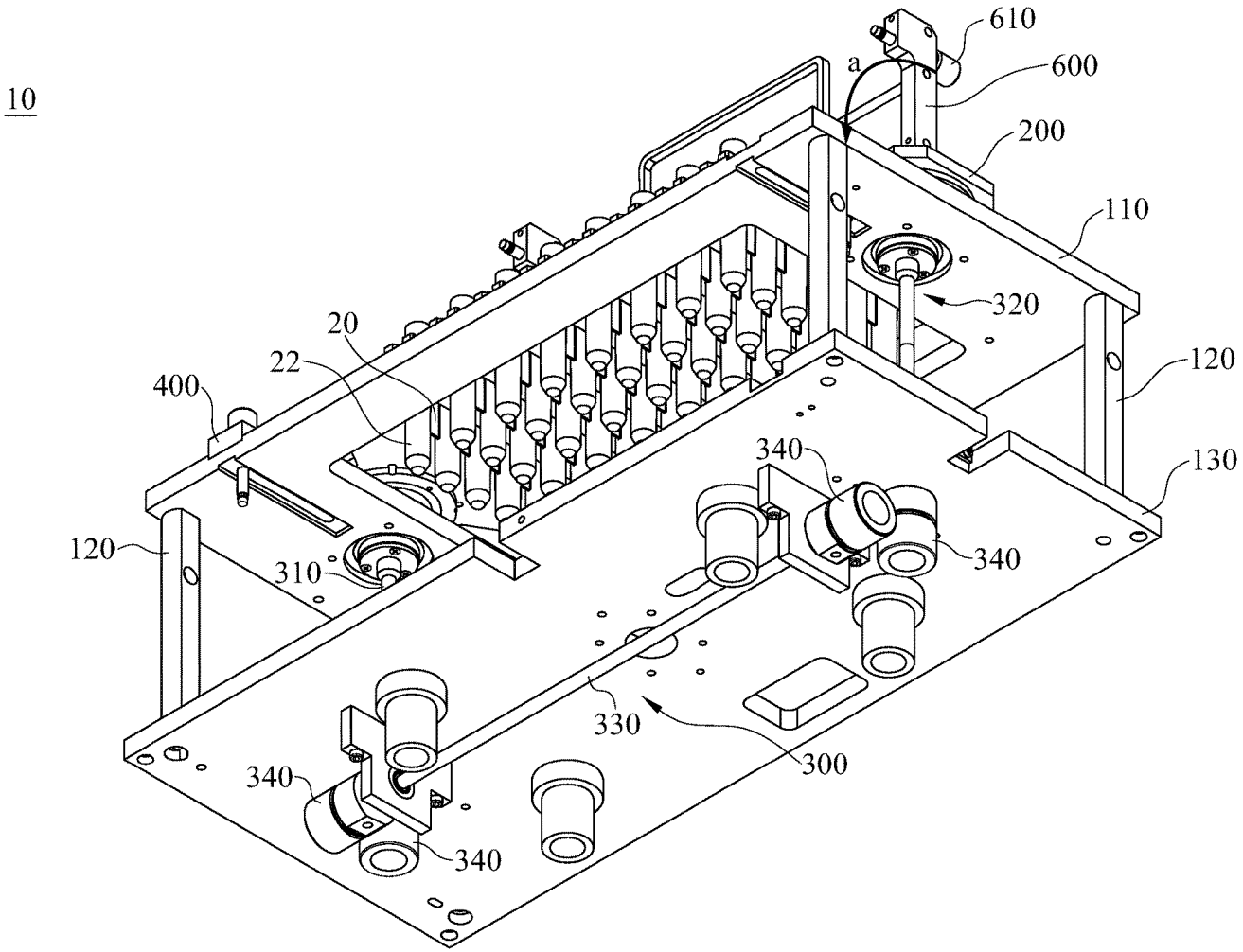
Figure 3:
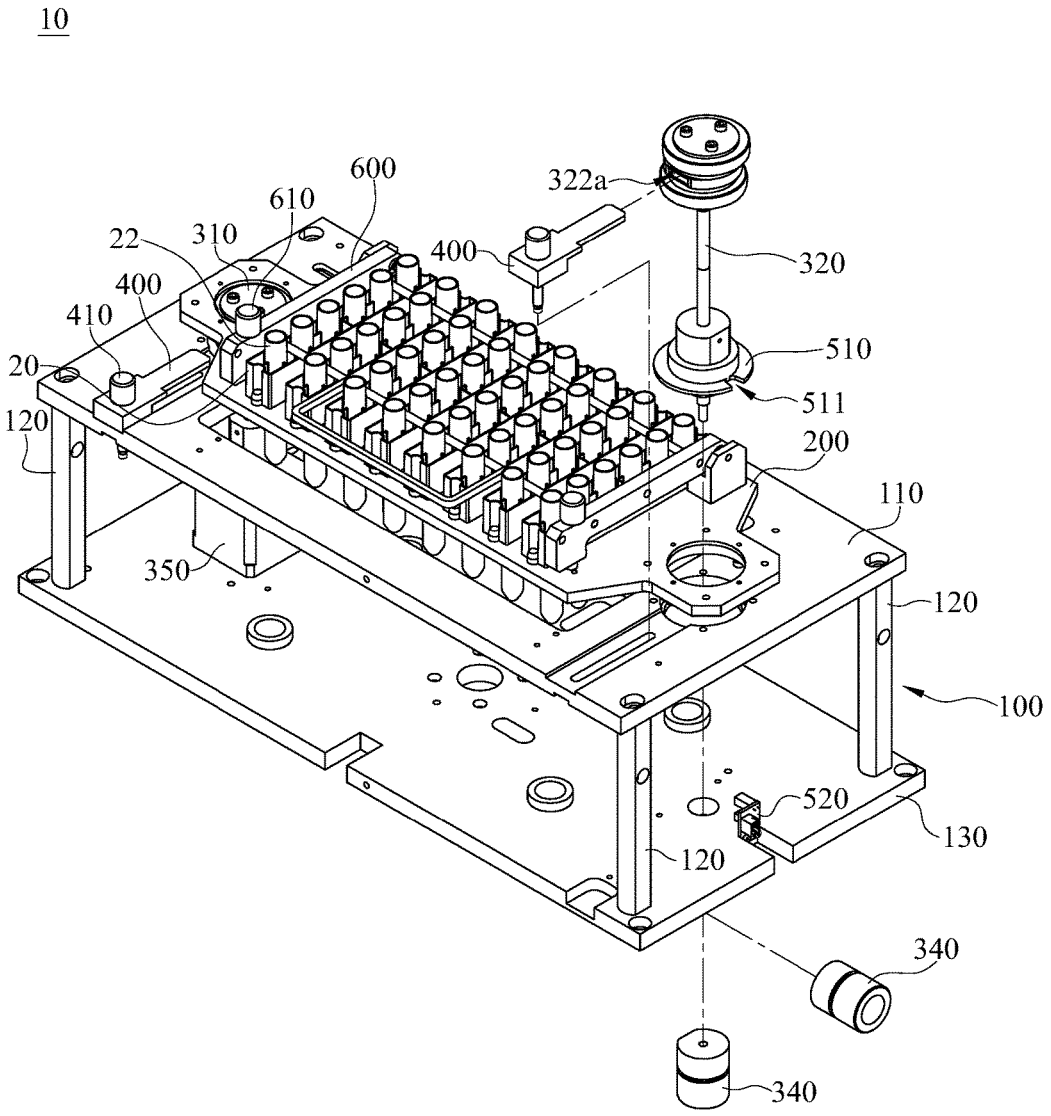
FIGS. 3-4 are exploded views of the shaker when a handle is closed according to the embodiment of the present disclosure.
Figure 4:
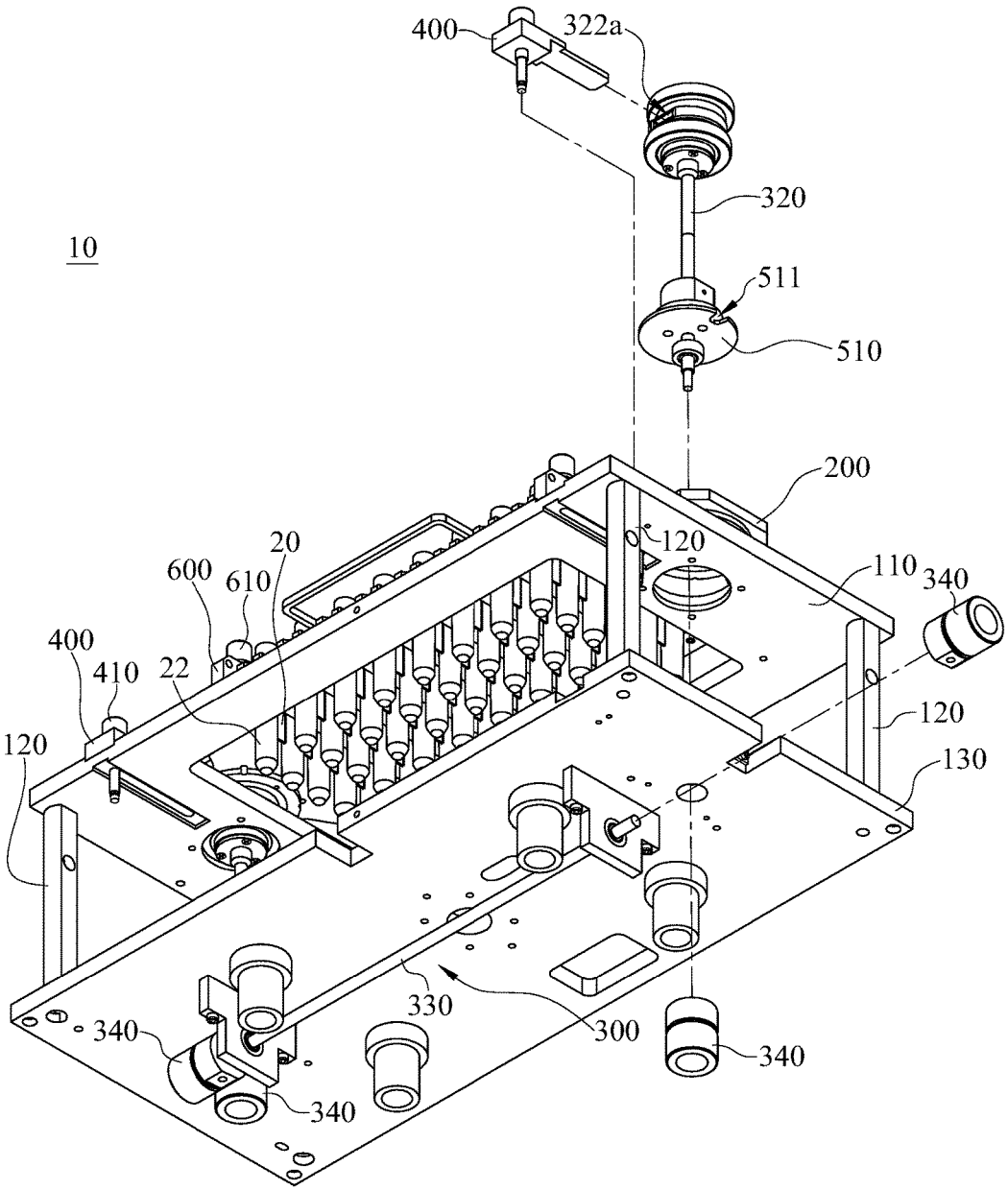

Please refer to FIGS. 1-4. FIGS. 1-2 are perspective views of a shaker according to a first embodiment of the present disclosure, and FIGS. 3-4 are exploded views of the shaker when a handle is closed according to the embodiment of the present disclosure.

In this embodiment, a shaker 10 is provided, and it also can be called "tube shaker". The shaker 10 is a tube shaker used to shake, mix, blend, or to agitate substances in tube. The shaker 10 includes a base 100, a holder 200, a drive assembly 300, a position board 510 and a position sensor 520.

The base 100 includes a top plate 110, plural supporting members 120 and a bottom plate 130. The supporting members 120 are connected between the top plate 110 and the bottom plate 130.

The holder 200 is located on a side of the top plate 110 away from the bottom plate 130. The holder 200 is movably disposed on the base 100. In this embodiment, plural test tubes 22 can be placed on the holder 200 via a test tube rack 20, but the present disclosure is not limited to the configurations of the test tubes 22 and the test tube rack 20.

The drive assembly 300 includes a first eccentric shaft 310, a second eccentric shaft 320, a drive shaft 330, plural magnetic members 340 and a power source 350.

Figure 5:
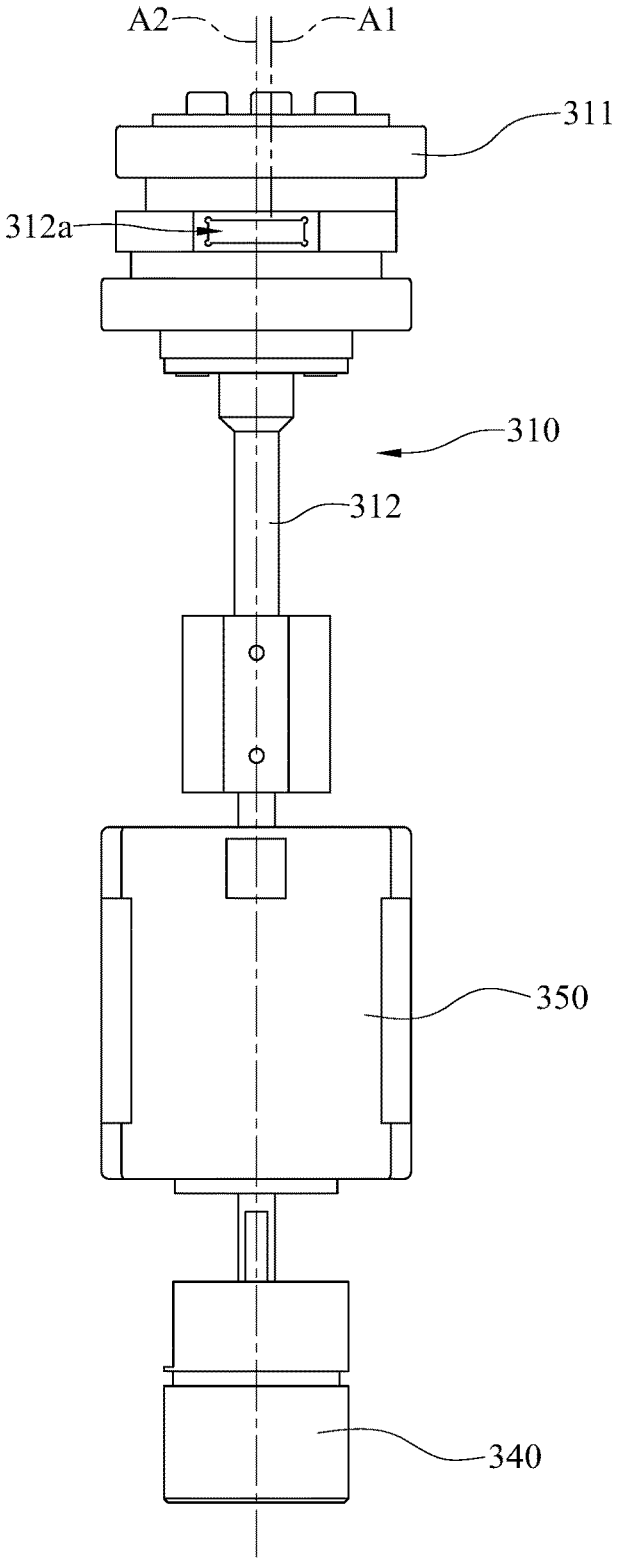
FIG. 5 is a side view of a first eccentric shaft in FIG. 3.
Figure 6:
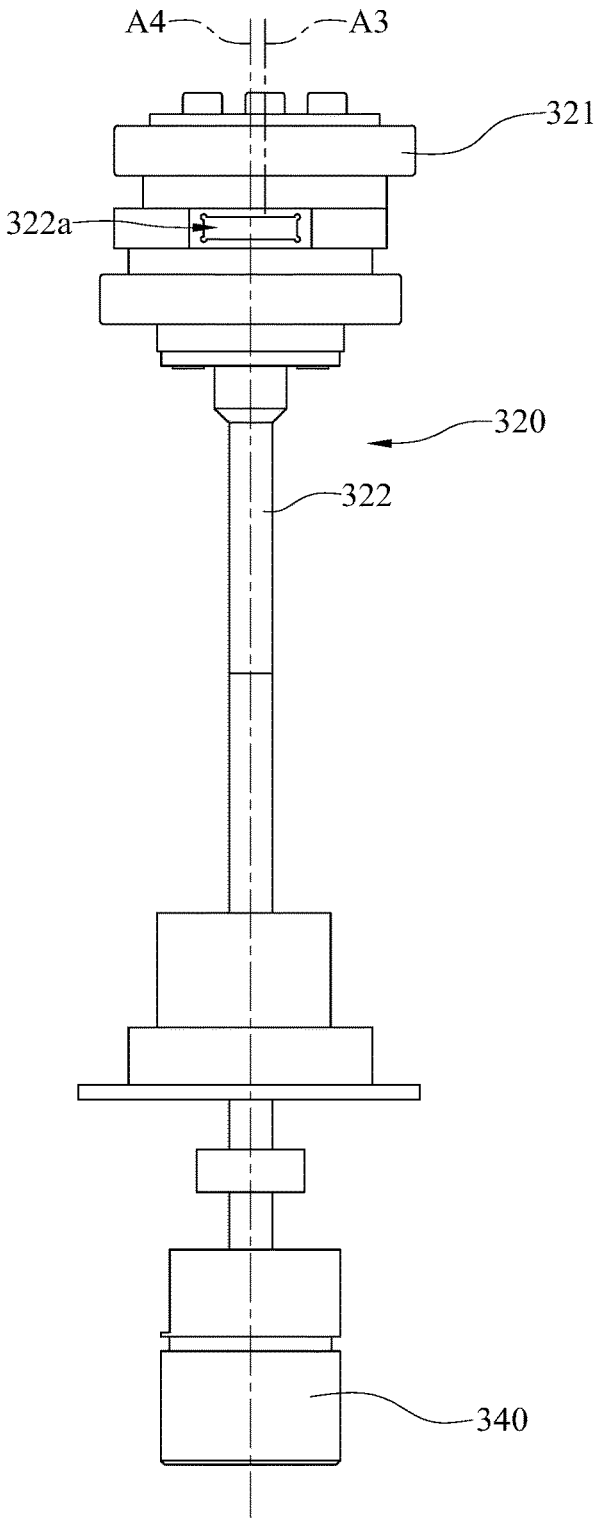
FIG. 6 is a side view of a second eccentric shaft in FIG. 3.

Please refer to FIGS. 5-6. FIG. 5 is a side view of a first eccentric shaft in FIG. 3, and FIG. 6 is a side view of a second eccentric shaft in FIG. 3.

The first eccentric shaft 310 includes a first part 311 and a second part 312. The first part 311 has an axis A1, the second part 312 has an axis A2, but the axis A1 and the axis A2 are non-coaxial. The first part 311 is pivoted on the holder 200. The second part 312 penetrates through the top plate 110 and the bottom plate 130, and a part of the second part 312 protrudes from a side of the bottom plate 130 away from the top plate 110.

The second eccentric shaft 320 includes a third part 321 and a fourth part 322. The third part 321 has an axis A3, the fourth part 322 has an axis A4, but the axis A3 and the axis A4 are non-coaxial. The third part 321 is pivoted on the holder 200. The fourth part 322 penetrates through the top plate 110 and the bottom plate 130, and a part of the fourth part 322 protrudes from a side of the bottom plate 130 away from the top plate 110.

The drive shaft 330 is located on a side of the bottom plate 130 away from the top plate 110. Two opposite ends of the drive shaft 330 respectively correspond to the second part 312 and the fourth part 322.

The magnetic members 340 are respectively disposed on the second part 312, the fourth part 322 and two opposite ends of the drive shaft 330. In detail, in this embodiment, there are four magnetic members 340; two of the magnetic members 340 are respectively disposed on the second part 312 and an end of the drive shaft 331 close to the second part 312, and the other two of the magnetic members 340 are respectively disposed on the fourth part 322 and an end of the drive shaft 331 close to the fourth part 322.

The magnetic member 340 is, for example, a metal sintering magnetic ring or a resin bonding magnetic ring. The magnetic members 340 can transmit power between the shafts without in contact with one another. In detail, the first eccentric shaft 310 can drive the drive shaft 330 to rotate by the magnetic force of two of the magnetic members 340, and the rotated drive shaft 330 can rotate the second eccentric shaft 320 by the other two of the magnetic force of the other two of the magnetic members 340.

To compare with the conventional belt drive shaker, the magnetic members 340 of the present disclosure are not in contact with one another, so the magnetic members 340 will not worn out, and the vibration to the shafts as well as the noise are relatively low during transmission. In other words, the magnetic members 340 are more stable in operation, simpler in design and easier to maintain. Furthermore, there is no longer generating belt debris.

The power source 350 is, for example, a motor. The power source 350 is located between the bottom plate 130 and the top plate 110. The power source 350 is configured for rotating the first eccentric shaft 310, and rotating the second eccentric shaft 320 through the magnetic members 340 and the drive shaft 330.

In this embodiment, the second part 312 of the first eccentric shaft 310 penetrates through the power source 350, but the disclosure is not limited thereto. In other embodiments, the first eccentric shaft can be disposed on one side of the power source 350.

In addition, in this embodiment, the first eccentric shaft 310 and the second eccentric shaft 320 are rotated jointly. The phase "rotated jointly" means that the first eccentric shaft 310 and the second eccentric shaft 320 are rotated at the same speed and the second part 312 of the first eccentric shaft 310 is eccentric in the same way as the second part 322 of the second eccentric shaft 320.

In this embodiment, the shaker 10 further includes two jigs 400. The second part 312 of the first eccentric shaft 310 further has a first slot 312*a*. The fourth part 322 of the second eccentric shaft 320 further has a second slot 322*a*. The jigs 400 are slidably disposed on the base 100 and respectively detachably inserted into the first slot 312*a* and the second slot 322*a*. The jigs 400 can respectively hold the first eccentric shaft 310 and the second eccentric shaft 320 at a fixed location, which is favorable for placing the first part 311 of the first eccentric shaft 310 and the third part 321 of the second eccentric shaft 320 at a specific position as well as favorable for assembling the holder 200 to assemble.

In addition, the jig 400 can be fixed in place on the top plate 110 of the base 100 via a fastener 410.

In this embodiment, the shaker 10 further includes a position board 510 and a position sensor 520. The position board 510 is, for example, a ring-shaped structure. The position board 510 sleeves on the fourth part 322 of the second eccentric shaft 320. The position board 510 has a crack 511 at the edge of the position board 510. The position sensor 520 is close to the position board 510, and a sensing area of the position sensor 520 is located on a motion path of the crack 511. In detail, the position board 510 is rotated with the fourth part 322 of the second eccentric shaft 320, so the crack 511 is moved along a circular path about the axis A4 of the fourth part 322. The sensing area of the position sensor 520 is located on the said circular path. When the position board 510 passes through the sensing area of the position sensor 520, the position sensor 520 generates a first signal. When the crack 511 is located in the sensing area of the position sensor 520, the physical portion of the position board 510 is no longer located in the sensing area of the position sensor 520, and the position sensor 520 generates a second signal.

In this embodiment, when the crack 511 is located in the sensing area of the position sensor 520, the first eccentric shaft 310 and the second eccentric shaft 320 are located at a pre-shaking position. That is, when the position sensor 520 generates the second signal, the first eccentric shaft 310 and the second eccentric shaft 320 are located at the pre-shaking position.

In this embodiment, the shaker 10 further includes a handle 600 pivoted on the holder 200. When the handle 600 is opened, the user is able to put the test tube rack 20 and the test tubes 22 onto the holder 200. When the handle 600 is closed, the test tube rack 20 is clamped between the handle 600 and the holder 200. In addition, when the handle 600 is closed, the handle 600 can be fixed in place on the holder 200 via a fastener 610.

Figure 7:
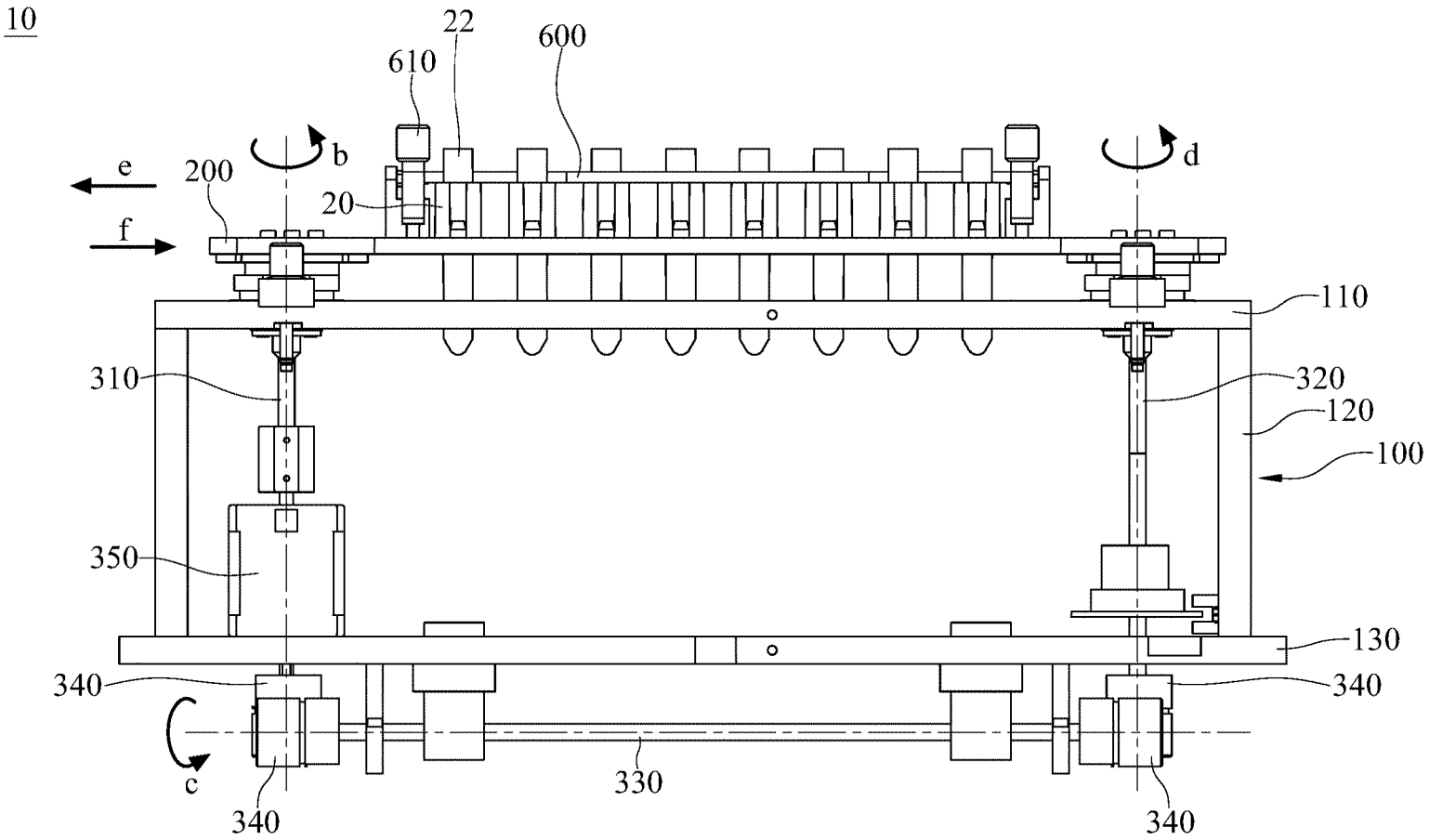
FIG. 7 is a front view of the tube shake when the handle is opened according to the first embodiment of the present disclosure.

Please refer to FIG. 1 and FIG. 7. FIG. 7 is a front view of the tube shake when the handle is opened according to the first embodiment of the present disclosure. The usage of the shaker 10 is described herein.

Firstly, the test tube rack 20 having the test tubes 22 is placed on the holder 200. Then, the handle 600 is closed by being rotated along a direction of arrow a, so the test rack 20 is clamped between the handle 600 and the holder 200 and fixed in place.

Then, the power source 350 rotates the first eccentric shaft 310 in a direction of arrow b. The rotated first eccentric shaft 310 drives the magnetic member 340 to rotate the drive shaft 330 in a direction of arrow c. The rotated drive shaft 330 drives the second eccentric shaft 320 to rotate in a direction of arrow d, so the rotated second eccentric shaft 320 is able to move the holder 200 in a direction of arrow e and a direction of arrow f. That is, the holder 200 and the test tubes 22 are shook and rotated. Accordingly, the specimen in the test tubes 22 is mixed.

After a predetermined time of shaking and rotating, the specimen in the test tubes 22 is thoroughly mixed. In such a case, the power source 350 will be slowed down until the position sensor 520 generates the second signal. That is, the power source 350 is slowed down to stop when the first eccentric shaft 310 and the second eccentric shaft 320 are located at the pre-shaking position. When the power source 350 is stopped, the user is able to open the handle 600 to take out the test tube rack 20.

According to the shaker as discussed above, it is driven by the magnetic members which are not in contact with one another, so the magnetic members will not worn out, and the vibration to the shaft as well as the noise are relatively low during transmission. In other word, the magnetic members are stable in operation, simple in design and easy to maintain. Furthermore, there is no longer generating belt debris.

In addition, the magnetic members have no need to be placed in contact with one another, so the magnetic members are easy to assemble.

Furthermore, the jigs can respectively hold the first eccentric shaft and the second eccentric shaft in a fixed location, which is favorable for the holder to assemble.

Moreover, it is convenient that the first eccentric shaft the second eccentric shaft can be automatically determined whether they are located at the pre-shaking position.

While this disclosure has been described in terms of several preferred embodiments, there are alterations, permutations, and equivalents, which fall within the scope of this disclosure. It should also be noted that there are many alternative ways of implementing the methods and apparatuses of the present disclosure. It is therefore intended that the following appended claims be interpreted as including all such alterations, permutations, and equivalents as fall within the true spirit and scope of the present disclosure.

What is claimed is:

1. A shaker, comprising:

a base;

a holder movably disposed on the base; and a drive assembly, comprising:

a first eccentric shaft, comprising a first part and a second part which are non-coaxial, and the first part pivoted on the holder;

a second eccentric shaft, comprising a third part and a fourth part which are non-coaxial, and the third part pivoted on the holder;

a drive shaft, two opposite ends of the drive shaft respectively corresponding to the second part and the fourth part;

a plurality of magnetic members respectively disposed on the second part, the fourth part and two opposite ends of the drive shaft; and a power source used for rotating the first eccentric shaft, and rotating the second eccentric shaft through the magnetic members and the drive shaft, wherein a rotational axis of each of the magnetic members disposed on the drive shaft is orthogonal to both a rotational axis of the magnetic member disposed on the second part of the first eccentric shaft and a rotational axis of the magnetic member disposed on the fourth part of the second eccentric shaft.

2. The shaker according to claim 1, further comprising two jigs, the first part of the first eccentric shaft having a first slot, the third part of the second eccentric shaft having a second slot, the two jigs slidably disposed on the base and respectively corresponding to the first slot and the second slot.

3. The shaker according to claim 1, further comprising a position board and a position sensor, the second eccentric shaft disposed through the position board, the position board having a crack, the position sensor near the position board, and a sensing area of the position sensor located on a motion path of the crack.

4. The shaker according to claim 1, wherein the first eccentric shaft and the second eccentric shaft are rotated jointly.

5. The shaker according to claim 1, further comprising a handle pivoted on the holder.

6. The shaker according to claim 1, wherein the power source is a motor.

7. The shaker according to claim 1, wherein the base comprises a top plate and a plurality of supporting members, the plurality of supporting members protrude from a side of the top plate away from the holder, and the holder and the magnetic members are respectively located on two opposite sides of the top plate.

8. The shaker according to claim 7, wherein the base further comprises a bottom plate, the supporting members are connected between the bottom plate and the top plate, and the bottom plate is located between the magnetic members and the top plate.

9. The shaker according to claim 8, wherein the power source is located between the bottom plate and the top plate.

* * * * *